United States Patent [19]

Blevins et al.

[11] Patent Number: 4,494,258

[45] Date of Patent: Jan. 22, 1985

[54] SOFA BED MECHANISM

[75] Inventors: Theodore J. Blevins; Paul R. Swiderski, both of Georgetown, Ky.

[73] Assignee: Hoover Universal, Inc., Ann Arbor, Mich.

[21] Appl. No.: 415,084

[22] Filed: Sep. 7, 1982

[51] Int. Cl.[3] ..... A47C 17/04

[52] U.S. Cl. ..... 5/29; 5/13

[58] Field of Search ..... 5/13, 28, 29, 51 D, 5/236 R, 237, 238, 312, 313 R

[56] References Cited

U.S. PATENT DOCUMENTS

| | | | |
|---|---|---|---|
| 2,615,502 | 10/1952 | Schnieder | 5/313 R |
| 3,067,438 | 12/1962 | Degen | 5/236 |
| 3,553,745 | 1/1971 | Sproll | 5/236 |
| 3,854,153 | 12/1974 | Fadler et al. | 5/51 D |
| 4,080,672 | 3/1978 | Eakins | 5/13 |
| 4,173,803 | 11/1979 | Kennedy | 5/13 |
| 4,301,559 | 11/1981 | Geenberghe | 5/13 |

*Primary Examiner*—Gary L. Smith
*Assistant Examiner*—Michael F. Trettel
*Attorney, Agent, or Firm*—Stephenson and Boller

[57] ABSTRACT

A sofa bed mechanism comprising a foldable bed frame having side and end rails and a back support slat extending between the side rails across the width of the bed frame at a position corresponding to the upper back area of a user in a sleeping position. The back support slat is bowed upwardly in its natural state and moves downwardly under load to yieldably resist the load and exert an outwardly directed force on the side rails. The slat has a top surface of substantial width so that it adds firmness to the bed without interfering with sleeper comfort. The invention further includes legs of semicircular cross section supporting the bed frame on the floor.

2 Claims, 8 Drawing Figures

SOFA BED MECHANISM

BACKGROUND OF THE INVENTION

This invention relates to sofa bed mechanisms of the type wherein a bed frame comprising side and end rails is mounted within a sofa frame for movement between an unfolded substantially planar bed position and a folded sofa position in which the bed frame is stored within the sofa frame. Among the principal objectives in mechanisms of this type is to provide firm, comfortable support for users in the bed position. Unfortunately, in the prior art mechanisms, the goals of "firmness" and "comfort" have rarely been achieved concurrently.

For example, U.S. Pat. No. 4,236,260, assigned to the assignee of the present invention, describes a sofa bed mechanism wherein a polypropylene fabric deck is stretched across the bed frame and secured to the side rails. This type of mechanism has been generally satisfactory both from the standpoint of firmness and comfort. However, there is a tendency in some situations for the polyproylene deck to experience localized sagging under the weight of an occupant, especially under the occupant's shoulders where weight is concentrated. Sagging results from the side rails of the bed frame being drawn inwardly by the deck under load, and detracts from the firmness and comfort of the mechanism.

Even less satisfactory from a comfort standpoint have been conventional mechanisms employing rigid cross tubes which extend between the side rails of the bed frame. These mechanisms have generally provided firm support, since the rigid cross tubes keep the side rails spaced apart. However, the cross rails have been extremely uncomfortable to bed users, especially in the shoulder area, since they protrude into users' backs.

Another problem frequently encountered in sofa bed mechanisms is in the legs used to support the unfolded bed frame on the floor. These legs must be strong enough to support the bed frame, yet they must not be so bulky as to significantly add to the dimensions of the folded unit when the bed frame is stored. Again, these dual objectives have rarely been met in a single prior art device.

It is an object of the present invention, therefore, to provide an improved sofa bed mechanism with improved back support to meet the aforementioned requirements of firmness and comfort.

It is another object of this invention to provide a sofa bed mechanism with improved support legs having improved strength characteristics while minimizing the amount of space taken up in the folded position.

SUMMARY OF THE INVENTION

The present invention provides a sofa bed mechanism with a foldable bed frame which includes side and end rails and a polypropylene deck extending between and secured to the side rails. A back support slat is added to the bed frame and extends between the side rails underneath the polypropylene deck at a position corresponding to the upper back area of a bed occupant. The back support slat is bowed upwardly in its natural state so that when a load is applied the slat moves downwardly and exerts an outwardly directed force on the side rails. This keeps the side rails apart under load, which in turn keeps the polypropylene deck taut to enhance comfort and firmness. The slat also acts as a stabilizing mechanism on the side rails, limiting the bending and twisting forces to which they would otherwise be exposed.

The back support slat has a top surface of substantial width so that the reaction force of the slat on the occupant is spread over a wide area. Furthermore, since the slat yields under load it adapts to the contours of the occupant's back and gives firm support without rigidly protruding against the occupant's back. The invention thus increases user comfort by providing firm support, yet it does so without rigid cross tubes which would cause user discomfort. Firmness and comfort are achieved simultaneously in the present invention.

The invention also provides an improved leg of semicircular cross section. The cross sectional shape of the leg enables it to be moved, when pivoted during folding of the bed frame, to a position adjacent the side rail to which it is attached in which the side rail tube is nested inside the leg. This helps minimize the amount of space taken up by the bed frame in the folded position. It has also been found that the semicircular cross section optimizes the strength characteristics of the leg so that support for the bed frame is increased.

Further objects, features and advantages of this invention will become apparent from a consideration of the appended claims, the following description and the accompanying drawing.

DETAILED DESCRIPTION OF PREFERRED EMBODIMENT

Figure 2:
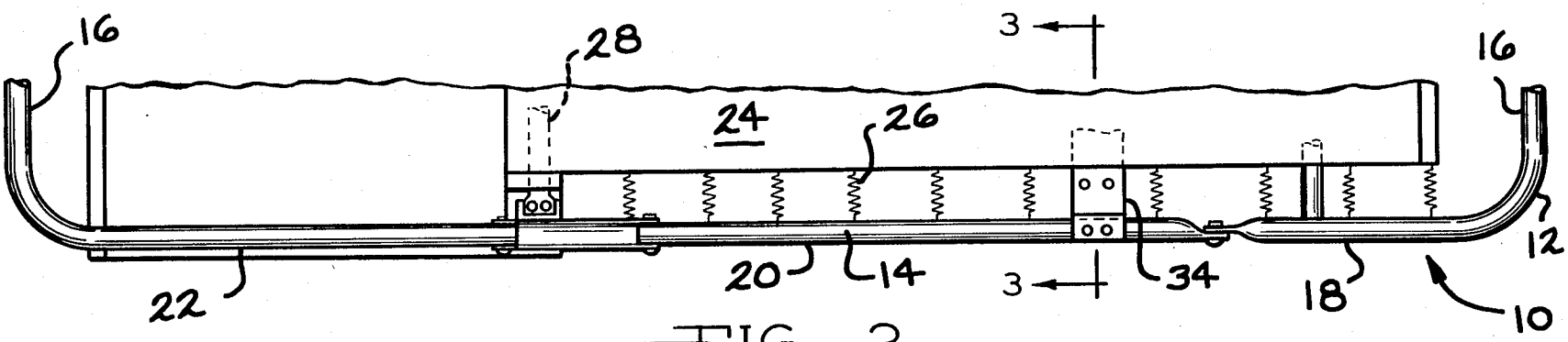
FIG. 2 is a side view of the sofa bed mechanism.
Figure 1:
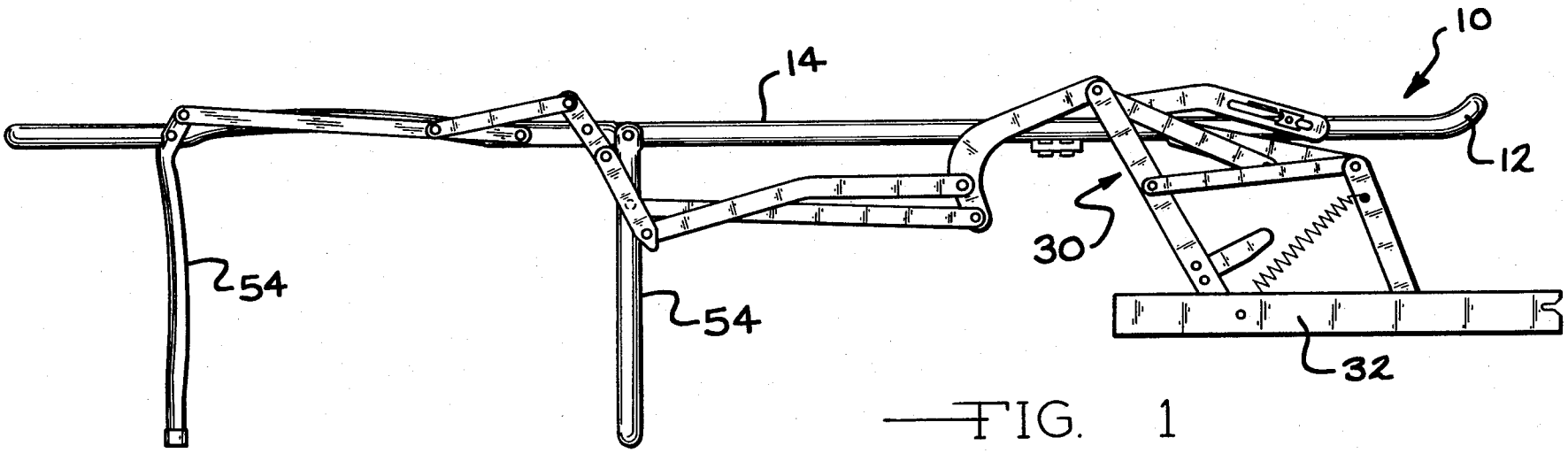
FIG. 1 is a top view of the sofa bed mechanism of this invention in the unfolded bed position.

With reference to the drawings, the sofa bed mechanism of this invention, indicated generally at 10, includes a bed frame 12 which is movable between an unfolded bed position, as seen in FIGS. 1 and 2, and a folded sofa position in which it is completely received within the storage space of a sofa frame (not shown). As seen in FIG. 1, the bed frame 12 consists of side rails 14 and end rails 16 pivotally connected at their ends to form a head section 18, an intermediate section 20 and a foot section 22. A polypropylene fabric deck 24 is provided on the bed frame 12 and is secured to the side rails 14 by means of springs 26. The polypropylene deck 24 is constructed according to the teachings of U.S. Pat. No. 4,236,260, which patent is hereby incorporated by reference. The bed frame 12 may also include one or more cross tubes 28 extending between the side rails 14 across the width of the bed frame, although it is undesirable to place cross tubes 12 near areas of concentrated weight, such as beneath the shoulders of a sleeping occupant. Movement of the bed frame 12 between its bed and sofa positions is governed by a linkage assembly, indicated generally at 30 in FIG. 2, pivotally mounted on a support member 32 which is adapted to be secured to the sofa frame.

Figure 4:
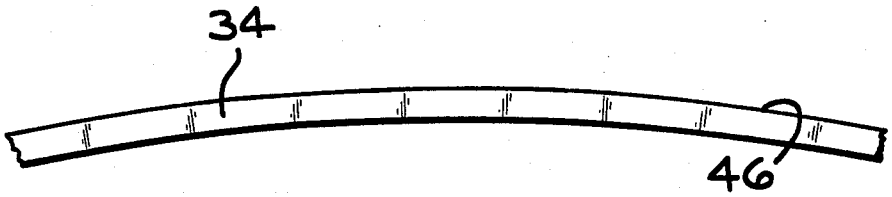
FIG. 4 is a longitudinal side view of a portion of the back support slat in its bowed natural state.

The mechanism 10 further includes a back support slat 34 which is secured to the side rails 14 and extends across the width of the bed frame 12 at a position corresponding to the upper back area of a bed occupant in a sleeping position. The slat 34 is bowed upwardly in its natural state, as seen in FIG. 4, and is operable to move downwardly under load to yieldably resist the load. When a load is placed on the slat 34, it exerts an outwardly directed force on the side rails 14 to ensure that the polypropylene deck 24 remains taut.

Figure 3:
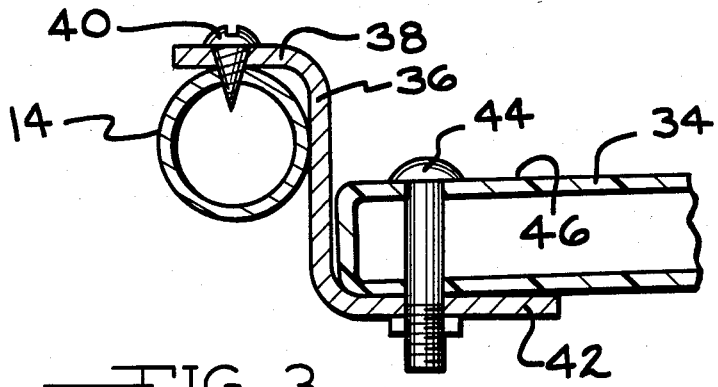
FIG. 3 is an enlarged fragmentary sectional view of the improved back support slat of this invention, as seen from the line 3—3 in FIG. 1.

As seen in FIG. 3, the back support slat 34 is secured to a side rail 14 by means of a substantially Z-shaped bracket 36. The bracket 36 has a top section 38 which is secured to the side rail 14 by means of a screw 40 and a lower section 42 to which the slat 34 is secured by means of a nut and bolt assembly 44. Thus, the slat 34 is positioned directly underneath the polypropylene deck 24.

Figure 5A:
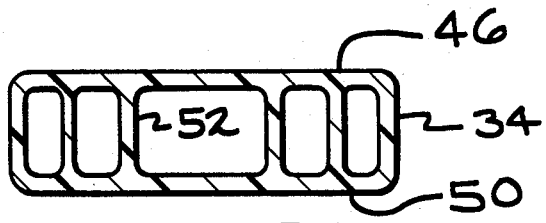
FIGS. 5A and 5B are alternative cross sectional views of the back support slat, FIG. 5A showing a molded plastic slat and FIG. 5B showing a wood slat.
Figure 5B:
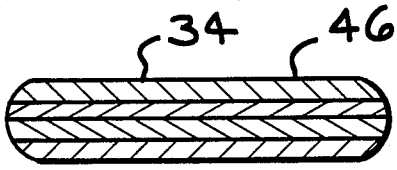

As seen in FIGS. 3-5, the slat 34 has a top surface 46 of substantial width. This spreads the reaction force of the slat 34 against the bed user over a wide area and therefore increases user comfort. The slat 34 has rounded edges to avoid uncomfortable protrusions. The slat 34 may be produced from a variety of materials and may take any of a variety of shapes. For example, it may be produced from molded plastic, as seen in FIG. 5A, so as to include top and bottom surfaces 46 and 50 and support columns 52. Alternatively, the slat 34 may be solid wood, as seen in FIG. 5B. It is to be understood that these are only examples of possible shapes and compositions of the slat 34 and the invention is not limited to these embodiments.

The mechanism 10 further includes a plurality of legs 54 pivotally mounted on the side rails 14 and extending between the bed frame 12 and the floor when the bed frame is in its unfolded position, as seen in FIG. 2. Each of the legs 54 has a semicircular cross sectional shape, as seen in FIG. 7. The semicircular shape optimizes the strength characteristics of the legs 54. When the bed frame 12 is folded, the foot section 22 is pivoted relative to the intermediate section 20 from its FIG. 1 position to its FIG. 6 position, that is, clockwise as viewed in the drawings. During this movement, the legs 54 attached to the side rail 14 at the foot section 22 is pivoted relative to the rail 14 to a position in which the leg 54 extends parallel to and substantially adjacent the rail 14. In this position, due to the semicircular shape of the leg 54. the rail 14 is nested within the leg 54, as seen in FIG. 7. This results in a minimum of space being consumed by the leg 54 in the sofa position of the bed frame 12.

Figure 6:
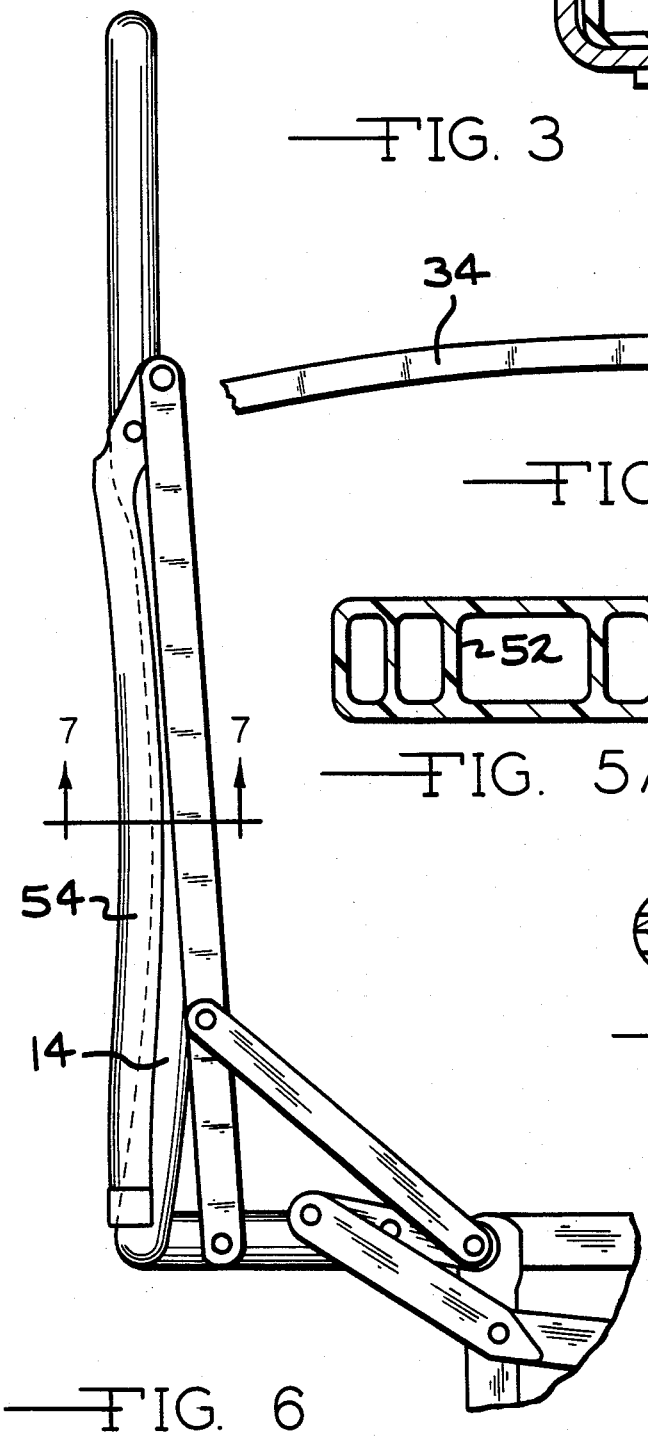
FIG. 6 is an enlarged side view of the improved leg of the sofa bed mechanism, shown in folded relation with a side rail tube.
Figure 7:
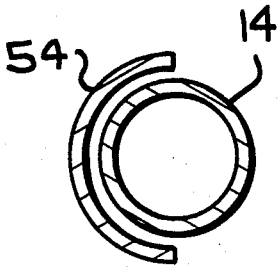
FIG. 7 is a cross sectional view of the side rail tube nested inside the leg, as seen from the line 7—7 in FIG. 6.

As seen in FIGS. 2 and 6, many conventional sofa bed frames have foot section side rails that are bowed upwardly when the bed frame is in its unfolded position. The leg 54 can be bowed correspondingly to conform to the shape of the side rail to ensure proper nesting of the leg 54 and the rail 14 when the bed frame is folded. Bowing of the leg 54 further increases its strength characteristics.

The invention thus provides an improved sofa bed mechanism 10 which incorporates an improved back support slat 34 and an improved leg 54. The slat 34 imparts firmness and comfort to the mechanism 10. The improved leg 54 provides improved floor support for the bed frame 12 and also ensures that the mechanism 10 takes up a minimum of space when stored.

What is claimed is:

1. In a sofa bed mechanism which includes a foldable bed frame having side and end rails, a back support slat secured to and extending between said side rails at a position substantially underlying the upper back area of an occupant in a sleeping position on said bed frame, a fabric deck secured to said side rails and extending across said bed frame at a position above said support slat, said back support slat being bowed upwardly in its natural state and being movable downwardly under load so that it yieldably resists said load and exerts an outwardly directed force on said side rails tending to keep said deck substantially taut between said side rails, said back support slat being positioned directly beneath said deck and being of substantial width to thereby spread the reaction force of the slat against a bed occupant for occupant comfort purposes.

2. A sofa bed mechanism comprising a foldable bed frame which includes side and end rails pivotally joined at their ends, a polypropylene deck secured to said side rails and extending across said bed frame, a back support slat secured to and extending between said side rails at a position corresponding to the upper back area of an occupant in a sleeping position on said bed frame, said back support slat being positioned directly beneath said polypropylene deck and having a top surface of substantial width to thereby spread the reaction force of the slat against a bed occupant for occupant comfort purposes, said back support slat being bowed upwardly in its natural state and movable downwardly under load to yieldably resist said load and exert an outwardly directed force on said side rails operable to stretch said polypropylene deck, and a plurality of support legs secured to said side rails.

* * * * *